United States Patent [19]

Amano

[11] Patent Number: 5,062,502

[45] Date of Patent: Nov. 5, 1991

[54] ELEVATOR CONTROLLING APPARATUS

[75] Inventor: Masaaki Amano, Inazawa, Japan

[73] Assignee: Mitsubishi Denki Kabushiki Kaisha, Japan

[21] Appl. No.: 511,403

[22] Filed: Apr. 19, 1990

[30] Foreign Application Priority Data

May 18, 1989 [JP] Japan ..... 1-22788

[51] Int. Cl.[5] ..... B66B 1/18

[52] U.S. Cl. ..... 187/124

[58] Field of Search ..... 187/101, 124; 364/138, 364/424, 164, 436

[56] References Cited

U.S. PATENT DOCUMENTS

| | | | |
|---|---|---|---|
| 4,524,418 | 6/1985 | Araya et al. | 364/436 |
| 4,672,531 | 6/1987 | Uetani | 364/138 |
| 4,802,082 | 1/1989 | Uetani | 364/138 |

*Primary Examiner*—A. D. Pellinen
*Assistant Examiner*—W. E. Duncanson, Jr.
*Attorney, Agent, or Firm*—Leydig, Voit & Mayer

[57] ABSTRACT

An elevator controlling apparatus of the present invention comprises a plurality of cage call devices for generating information with respect to cage calls from each of a plurality of cages in; a plurality of cage controlling devices which are provided in correspondence with a plurality of elevator cages, which generate information with respect to hall calls and cage traffic information and which control the operation of the elevator cages; a learning device which calculates the total traffic value in each unit time zone on the basis of the cage traffic information so that when the total traffic in a unit time zone is similar to that of an adjacent unit time zone, these time zones are set as the a divided time zone, and when a divided time zone is over a predetermined time, the next divided time zone is set; and an operation controlling device for controlling the plurality of cage controlling devices on the basis of the total traffic for the each unit time zone, the divided time zones, the information with respect to cage calls and the information with respect to hall calls.

6 Claims, 7 Drawing Sheets

FIG. 2

| TRAFFIC / FLOOR: J | UPWARD TRAFFIC | | DOWNWARD TRAFFIC | |
|---|---|---|---|---|
| | GU+(J, I) UPWARD RIDING LOAD | GU−(J, I) UPWARD ALIGHTING LOAD | GD+(J, I) DOWNWARD RIDING LOAD | GD−(J, I) DOWNWARD ALIGHTING LOAD |
| 10 | | | | |
| 9 | | | | |
| 8 | | | | |
| 7 | | | | |
| 6 | | | | |
| 5 | | | | |
| 4 | | | | |
| 3 | | | | |
| 2 | | | | |
| 1 | | | | |

FIG. 3

| TRAFFIC \ UNIT TIME ZONE | | (I=0) 0:00 ~ 0:05 | (I=1) 0:05 ~ 0:10 | (I=2) 0:10 ~ 0:15 | (I=3) 0:15 ~ 0:20 | | (I=286) 23:50 ~ 23:55 | (I=287) 23:55 ~ 24:00 |
|---|---|---|---|---|---|---|---|---|
| UPWARD TRAFFIC | UPWARD RIDING LOAD GU+(J, I) | | | | | | | |
| | UPWARD ALIGHTING LOAD GU−(J, I) | | | | | | | |
| | UPWARD TRAFFIC IN 5 MINUTES FU(I) | | | | | | | |
| DOWNWARD TRAFFIC | DOWNWARD RIDING LOAD GD+(J, I) | | | | | | | |
| | DOWNWARD ALIGHTING LOAD GD−(J, I) | | | | | | | |
| | DOWNWARD TRAFFIC IN 5 MINUTES FD(I) | | | | | | | |

ELEVATOR CONTROLLING APPARATUS

BACKGROUND OF THE INVENTION

1. Field of the Invention

The present invention relates to an elevator controlling apparatus which performs direct numerical control in correspondence with the divided time zones established by dividing a day into a substantially constant number of time zones, and particularly to an elevator controlling apparatus which is capable of optimizing divided time zones by statistically processing variation in the load (traffic) on an elevator for one day.

2. Description of Related Art

In recent years, elevator controlling apparatuses used for direct numeral control of a plurality of elevator cages have been capable of advanced control based on the arithmetic operation of a large quantity of information. For example, there are many elevator controlling apparatuses which are provided with a learning function to modify direct numeral control in accordance with traffic, which easily varies, by the statistical processing of the traffic in a day in a building.

It is generally known that the traffic in a building varies depending upon various factors such as the office-going time zone in the morning and the normal time zone in the daytime, the direction of movement of an elevator and so forth. An elevator controlling apparatus has been thus proposed in which the time of day is divided into a predetermined number of time zones, and statistical processing and the formation of control information are performed by using as a unit each of the divided time zones, as disclosed in Japanese Patent Laid-Open No. 58-113085. Although the predetermined number of time zones into which a day is divided depends upon the performance of the processor used and the memory capacity of learning means and operation controlling means, it is generally about 24 or 36.

However, in the aforementioned controlling apparatus disclosed in the publication, divided time zones are established so that the traffic values in all the divided time zones are equal to each other. Namely, each of divided time zones having low traffic values is set to be long, and each of divided time zones having high traffic values is set to be short. Thus, the actual time at which traffic value in a building changes does not always agree with the time on the border between two divided time zones, and the characteristics of the traffic in the building cannot be correctly reflected.

As described above, conventional elevator controlling apparatuses have the problem that, since the divided time zones are determined so that the values of traffic in the time zones are equal to each other, the actual characteristics of traffic in a building cannot be reflected, and direct numeral control cannot be properly effected.

SUMMARY OF THE INVENTION

The present invention is directed to resolving the above problem, and it is an object of the present invention to provide an elevator controlling apparatus in which the time of day is divided into time zones so that the characteristics of the traffic change in a day can be reflected in the time zones, whereby direct numerical control can be performed in accordance with the traffic change in a building.

An elevator controlling apparatus in accordance with the present invention comprises a plurality of cage call registering means for generating information with respect to a cage call in correspondence with a plurality of cage; a plurality of cage controlling means which are provided corresponding to a plurality of elevator cages, which generate information with respect to hall call and cage traffic information for each of the elevator cages and which control the operation of each of the elevators; learning means which calculates the total traffic in each unit time zone on the cage basis of the traffic information so that when the total traffic in a unit time zone is similar to the total traffic in an adjacent unit time zone, the two unit time zones are set as the same unit time zone and, when one divided time zone has a time over a predetermined time, the next divided time zone is set; and operation controlling means for controlling the plurality of cage controlling means on the basis of the total traffic in the unit time zones, and the information with respect to cage calls and the information with respect to hall calls.

BRIEF DESCRIPTION OF THE DRAWINGS

FIGS. 2 and 3 are respectively drawings of memory areas in a statistical memory in the same embodiment;

DESCRIPTION OF THE PREFERRED EMBODIMENTS

An embodiment of the present invention is described below with reference to the attached drawings.

Figure 1:
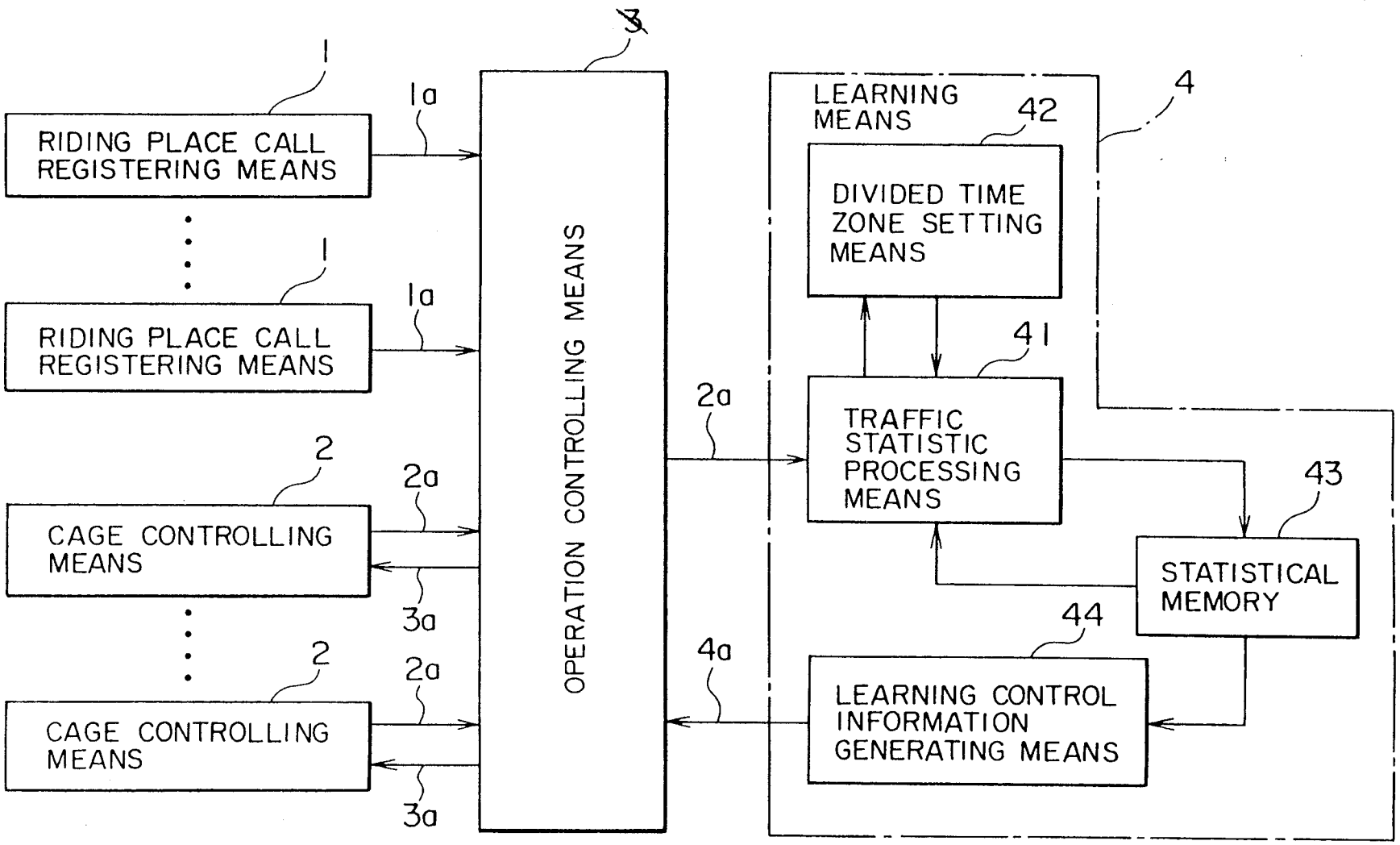
FIG. 1 is a block diagram of an elevator controlling apparatus in an embodiment of the present invention.

In FIG. 1, reference numeral 1 denotes a cage call call registering means which is provided for each cage and each direction of movement of an elevator; reference numeral 2, a cage controlling means for controlling each of the elevator cages (not shown); and reference numeral 3, an operation controlling means for generating an operation command 3*a* on the basis of the information 1*a* with respect to a cage call input from each of the cage call registering means 1 and the traffic information 2*a* input from each of the cage controlling means 2.

Reference numeral 4 denotes a learning means for learning the state of each elevator (traffic state) in a building from the traffic information 2*a* input through the operation controlling means 3 so as to generate control information 4*a*. The learning means 4 comprises a traffic statistic processing means 41 for statistically processing traffic on the basis of the cage traffic information 2*a*, a divided time zone setting means 42 for setting divided time zones by dividing the time of one day into a predetermined number of time zones on the basis of the statistical results obtained from the traffic statistic processing means 41, a statistical memory 43 for storing the divided time zones and the statistical results, and a learning control information generating means 44 for generating control information 4*a* for the operation controlling means 3 on the basis of the divided time zones and the statistical results.

FIGS. 2 and 3 are respectively explanatory views of the memory areas formed on the statistical memory 43, in which FIG. 2 shows the upward and downward traffic at each floor and FIG. 3 shows the upward and downward traffic in each of the unit time zones. In FIG. 2, character J denotes the floor numbers in a building (in this case, J=1 to 10) and character I denotes the unit time zones (I=0 to 287) when the time of a day is divided by 5 minutes to form 288 time zones. $GU_+(J,I)$ denotes the riding load in the upward direction; $GU_-(J,I)$, the alighting load in the upward direction; $GD_+(J,I)$, the riding load in the downward direction; and $GD_-(J,I)$, the alighting load in the downward direction, at a floor J in the unit time zone I; the unit of each load corresponding to the number of passengers loaded. With respect to the unit time zones I shown in FIG. 3, I=0, 1, . . . 287 correspond to 0:00 to 0:05, 0:05 to 0:10, . . . , 23:55 to 24:00, respectively. FU(I) denotes the upward traffic in 5 minutes and FD(I) denotes the downward traffic in 5 minutes, at all the floors in each of the unit time zones I.

A description will now be given of the operation of the this embodiment.

The traffic value which varies by the minute in a building is measured on the basis of the riding load and the alighting load, which are detected by the weighing apparatus (not shown) provided in each of the elevator cages and input as the cage traffic information 2*a* to the operation controlling means 3 from the cage controlling means 2. This cage traffic information 2*a* includes floors at which each of the elevator cages stops and the direction of movement of each of the elevator cages. The cage traffic information 2*a* is transmitted from each of the elevator cages to the operation controlling means 3 through the cage controlling means 2 at each time each of the elevator cages stops. The cage controlling means 2 transmits the cage traffic information 2*a* and the information with respect to hall calls for to the operation controlling means 3. The cage call registering means 1 transmits the information 1*a* with respect to hall calls for and so on to the operation controlling means 3.

The operation controlling means 3 transmits the cage traffic information 2*a* to the traffic statistic processing means 41 with a predetermined period, and the traffic statistic processing means 41 accumulates the cage traffic information 2*a* in 5 minute intervals and statistically processes the cage traffic information 2*a*. Namely, the elevator load in each 5 minute time period is determined at each floor and then stored in the statistical memory 43, as shown in FIGS. 2 and 3.

Figure 4:
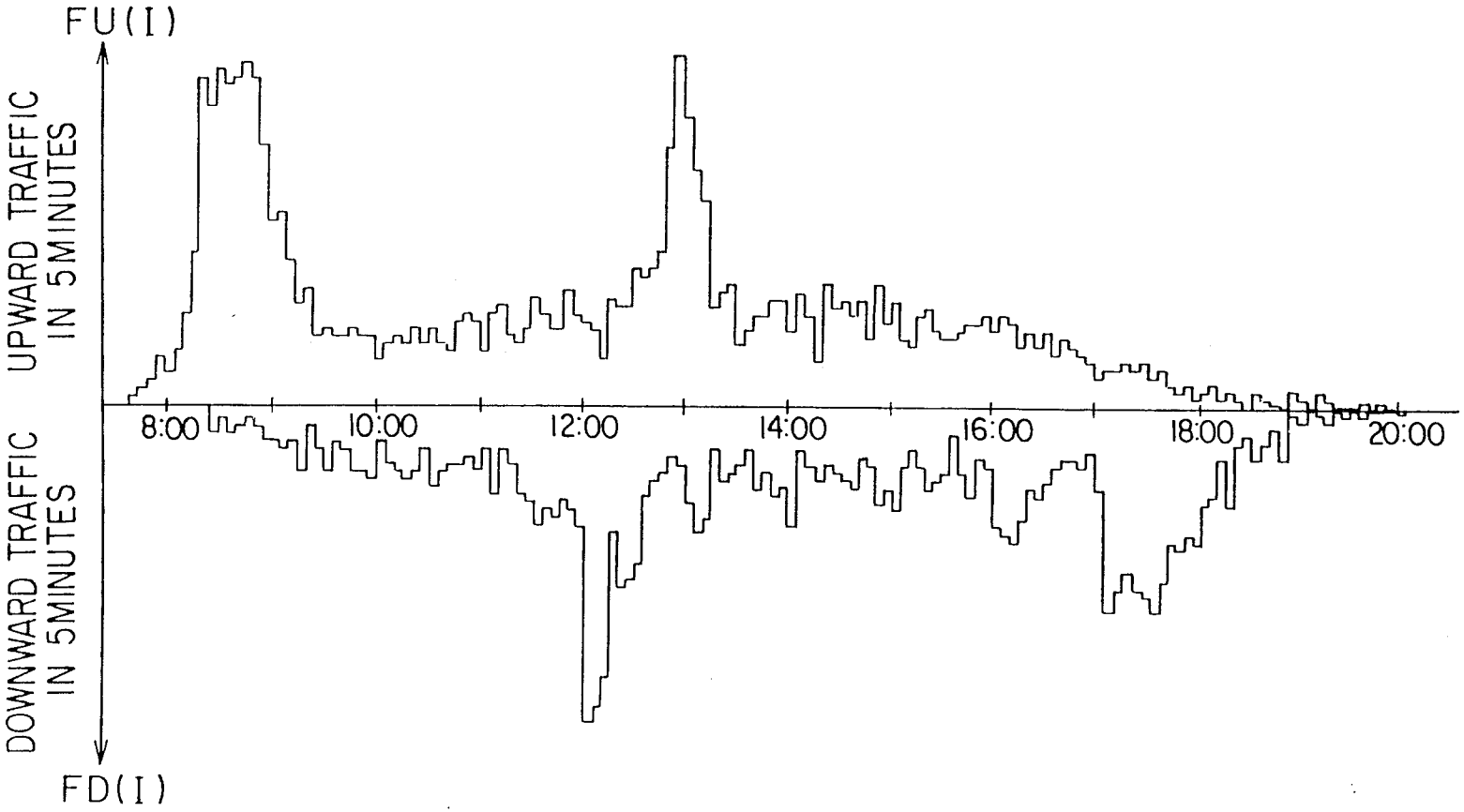
FIG. 4 is a graph which shows the traffic in each unit time zone.

In an example in which the statistics of passengers are generated at each of the floors J in the first unit time zone (I=0) from 0:00 to 0:05 of a day, the upward traffic FU(0) in 5 minutes and the downward traffic FD(0) in 5 minutes are expressed by the following equations:

$$FU(0) = (1/2) \sum_{J=1}^{M} \{GU + (J,0) + GU - (J,0)\}$$

$$FD(0) = (1/2) \sum_{J=1}^{M} \{GD + (J,0) + GD - (J,0)\}$$

wherein M denotes the maximum floor number and, in this case, M=10. The traffic statistics in a day are collected by determining the traffic values at all the floors in each of the unit time zones I in the same way as that described above. FIG. 4 is a graph which shows the thus-obtained traffic statistics with the time axis on the abscissa.

A predetermined number of divided time zones are then set on the basis of the characteristics of the traffic shown in FIG. 4. If the data shown in FIG. 4 is used without any change, however, there is a danger of oversensitive detection of the traffic change. The traffic statistic processing means 41 thus determines relaxed data of the traffic change by using the data of the time zones before and after each unit time zone before the divided time zones are established.

In this example, the corrected upward traffic $F_U(I)$ in 5 minutes and the corrected downward traffic $F_D(I)$ in 5 minutes in each of the unit time zones I are expressed by the following equations:

$$F_U(I)=\alpha FU(I)+(1-\alpha)FU(I-1)/2+(1-\alpha)\cdot FU(I+1)/2 \quad (1)$$

$$F_D(I)=\alpha FD(I)+(1-\alpha)FD(I-1)/2+(1-\alpha)F\cdot D(I+1)/2 \quad (2)$$

wherein $\alpha$ $(0<\alpha<1)$ denotes a correction factor, for example, it is set to about 0.8. From the equations 1 and 2, the corrected traffic F(I) for 5 minutes in each of the unit time zones I is determined by the following equation:

$$F(I)=F_U(I)+F_D(I) \quad (3)$$

Figure 5:
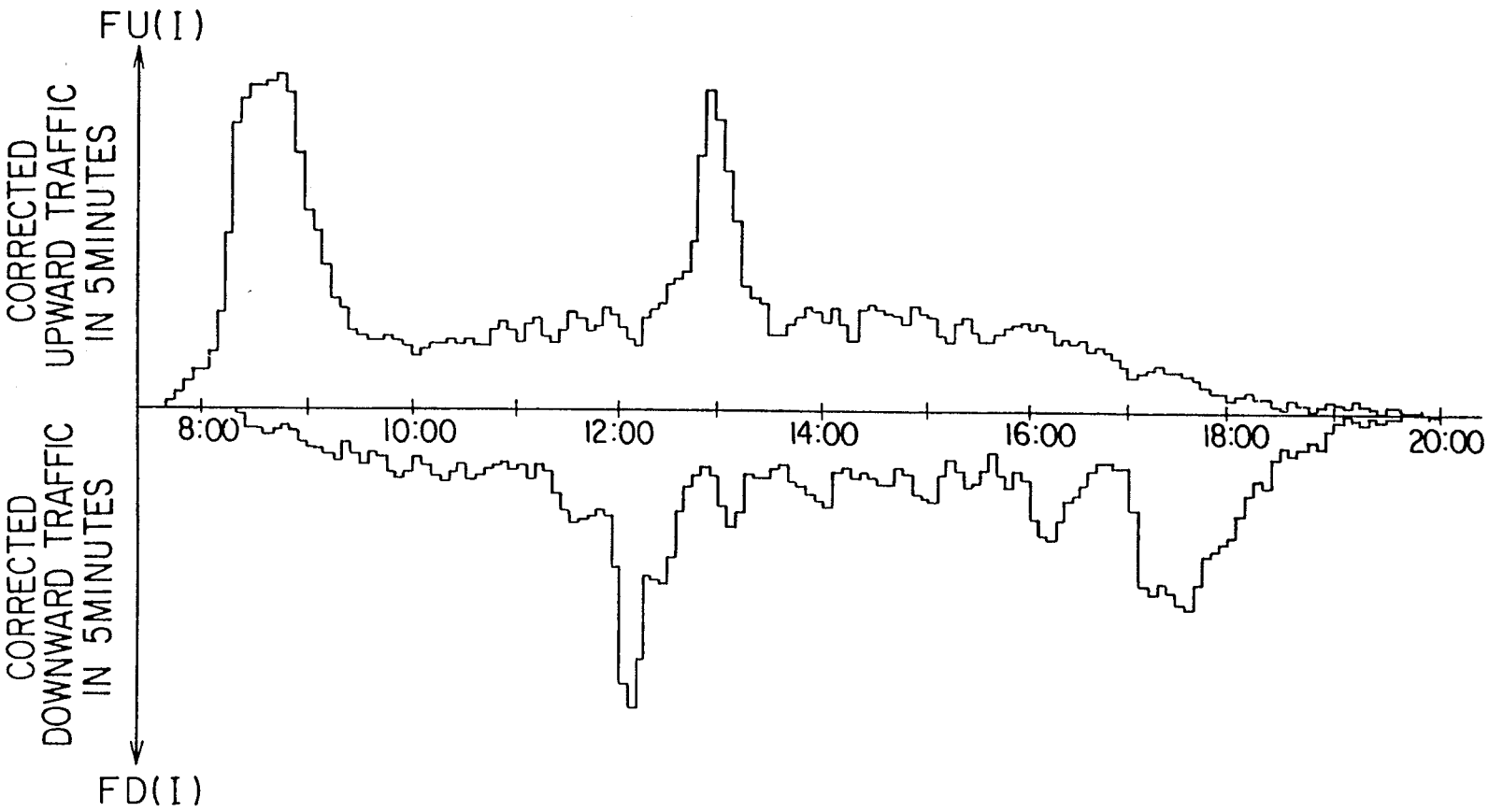
FIG. 5 is a graph which shows the corrected traffic obtained by correcting the traffic shown in FIG. 4.

The thus-determined corrected data which is relaxed by the effect of the data of the adjacent unit time zones is stored as statistical results in the statistical memory 43. FIG. 5 shows the statistical results obtained by correcting the traffic shown in FIG. 4.

Figure 6:
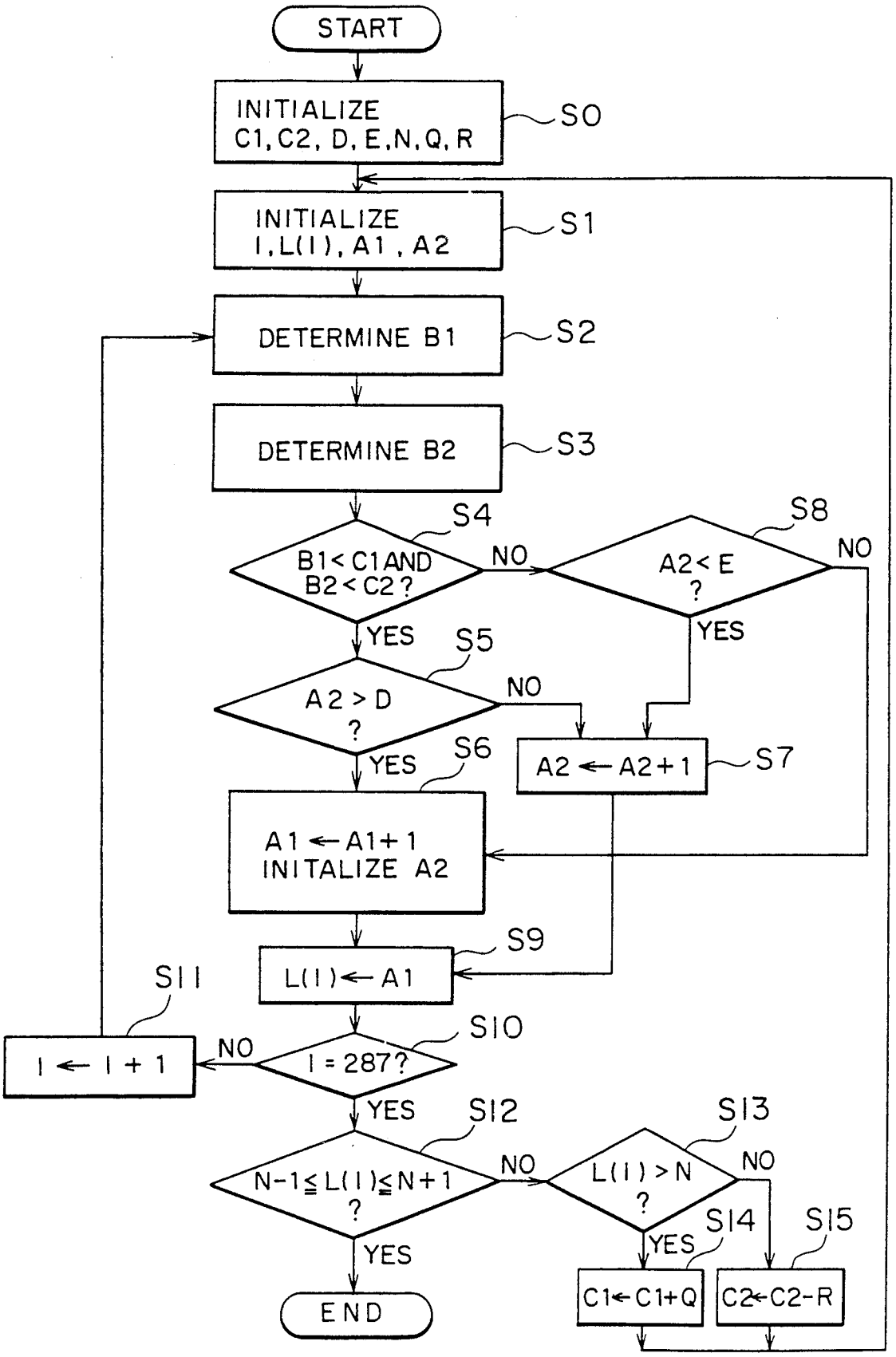
FIG. 6 is a flow chart which shows the operation of the embodiment.

The divided time zones are then set by the traffic statistic processing means 41. The setting operation is described below with reference to the flow chart shown in FIG. 6.

In Steps S0 and S1, each variable is first initialized. For example, in Step S0, the first criterion value C1 is set to 1; the second criterion value C2, 50; the allowable maximum D, 13; the allowable minimum E, 4; the reference value N of the number of divided time zones, 24; the correction value Q for the first criterion value C1, 0.05; and the correction value R for the second criterion value C2, 3. In Step S1, the unit time zone I is set to 1; the label L(O) of the divided time zone at the first unit time zone I=0, 1; the accumulated number A1 of the divided time zones, 1; and the accumulated number A2 of the time zone units in one divided time zone, 1.

The reference value N, the label L(I), each of the accumulated numbers A1 and A2 and each of the corrected values Q and R are written in the traffic statistic processing means 41. Each of the criterion values C1 and C2, the allowable maximum D and the allowable minimum E are written in the divided time zone setting means 42.

In Step S2, the traffic statistic processing means 41 determines the relative ratio B1 of the corrected traffic for 5 minutes between adjacent time zones by using the following equation:

$$B1=F(I-1)/F(I)=\{F_U(I-1)+F_D(I-1)\}\div\{F_U(I)+F_D(I)\}$$

In Step S3, the absolute difference B2 of the corrected traffic for 5 minutes between adjacent time zones by using the following equation:

$$B2=|F(I-1)-F(I)|$$

These values are transmitted to the divided time zone setting means 42.

The divided time zone setting means 42 compares the relative ratio B1 and the absolute difference B2 with the first and second criterion values C1 (=1) and C2 (=50), respectively, so as to make a decision as to whether or not the relative ratio B1 and the absolute difference B2 are smaller than the criterion values C1 and C2, respectively, and whether or not the traffic change has a characteristic.

If the traffic change has no characteristic and if B1<C1 and B2<C2, the processing proceeds to Step S5 in which a decision is made as to whether or not the accumulated number A2 of the unit time zones is larger than the allowable maximum D (=13). If the accumulated number A2 is larger than the allowable maximum D, in Step S6, the accumulated number A1 of the divided time zones is increased by one and the accumulated number A2 of the unit time zones is initialized to 1.

While if the accumulated number A2 is not larger than the allowable maximum D, in Step S7, the accumulated number A2 is increased by one, and the label L(I) of this unit time zone I is included in the same divided time zone as that of the before unit.

During this operation, the processing in Steps S5 and S6 is performed for preventing any case in which, when the unit time zones with small traffic variation occur in a long time, all the unit time zones during this time are included in the same divided time zone. In other words, if it is decided in Step S5 that a divided time zone has a time over a predetermined time (1 hour corresponding to A2=12), the accumulated number A1 of the divided time zones is increased so that the next divided time zone is set in Step S6. This is because, even if the traffic change between a unit time and the adjacent unit time is small, if the direction of the change is the same, the total of the traffic change sometimes becomes large after a long time has passed, and it is thus unreasonable to set these unit times as one divided time zone.

While, when the traffic change has a characteristic and it is decided in Step S4 that B1≧C1 or B2≧C2, the processing proceeds to Step S8 in which a decision is made as to whether or not the accumulated number A2 is smaller than that allowable minimum E (=4). If the accumulated A2 is not smaller than the allowable minimum E, the processing proceeds to Step S6 in which the next divided time zone is set, and if the accumulated number A2 is smaller than the allowable minimum E, the processing proceeds to Step S7.

The processing in Steps S7 and S8 is performed for preventing a case in which, when the corrected traffic for 5 minutes in a unit time zone significantly varies as compared with the traffic in the adjacent unit time zone, the unit time zone is set as one divided time zone. Namely, when it is decided in Step S8 that a divided time zone does not have a time smaller than a predetermined time (15 minutes corresponding to A2=3), the accumulated number A2 is increased by one in Step S7, and this unit time zone is included in the same divided time zone as that of the previous unit. This is because, when the traffic significantly varies, if the divided time zones are set to short times (for example, the unit time), the number of divided time zones is too large, resulting in the oversensitive response to error such as negligible statistical error.

The thus-determined accumulated number A1 of the divided time zones with the unit time zone I which is set in Step S6 or S7 is transmitted to the traffic statistic processing means 41 and stored as the label L(I) for the divided time zones in Step S9. The unit time zones set in the same divided time zone have the same label.

In Step S10, the traffic statistic processing means 41 then makes a decision as to whether or not the processing for all the unit time zones I is completed until I reaches 287. If the processing is not completed, the unit time zone I is increased by one in Step S11, and the processing is returned to Step S2 in which the processing for the next unit time zone (I+1) is performed.

While if the processing is completed for all the unit time zones I, the label L(I) of the divided time zones is compared with the reference value N (=24) in Step S12, and a decision is made as to whether or not the label L(I) is within the range of N±1. If N−1≦L(I)≦N+1, the operation of setting the divided time zones is completed.

While, if it is decided that the label L(I), i.e., the number of divided time zones, is out of the range of N±1, a decision is made in Step S13 as to whether or not the label L(I) is greater than the reference value N. If the label is greater than the reference value N, in Step S14, the criterion value C1 for the relative ratio B1 is set so as to be increased by the correction value Q (=0.05). While, if the label L(I) is smaller than the reference value N, in Step S15, the criterion value C2 for the absolute difference B2 is set so as to be decreased by the correction value R, and the processing then proceeds to Step S1 for initialization in which the process of setting the label L(I) is carried out over again. The repeated execution of the processing from Steps S1 to S15 finally causes the number of divided time zones to be reduced to a number within the range of N±1.

Figure 7:
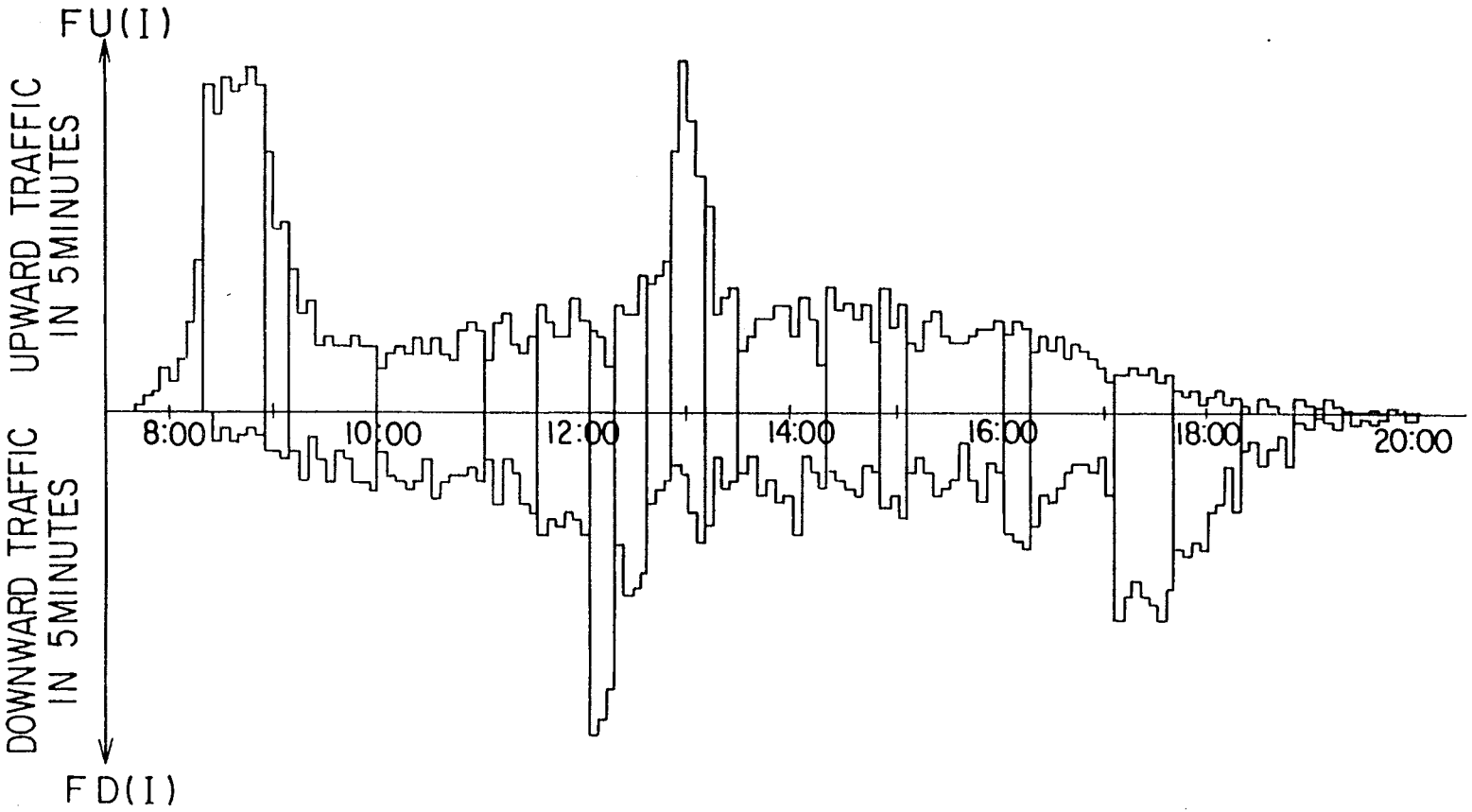
FIG. 7 is a graph which shows traffic divided by time zones in the embodiment.

In this way, if the time of a day is divided to form, for example, 24 divided time zones, on the basis of the characteristics of the traffic change in a day, the graph shown in FIG. 7 is obtained. Such divided time zones are set at the end of every day and transmitted to the learning control information generating means 44.

The learning control information generating means 44 generates the control information 4*a* on the basis of the divided time zones and the statistical results which are transmitted from the statistical memory 43 and transmits the control information 4*a* to the operation controlling means 3. The operation controlling means 3 generates the operation command 3*a* on the basis of the control information 4*a*, and the information 1*a* with respect to hall calls and transmits the operation command 3*a* to the each of the cage controlling means 2. As a result, the divided times zones which are set for each day can be reflected on the direct numeral control in the next day so that direct numeral control can be correctly effected.

What is claimed is:

1. An elevator controlling apparatus comprising:

a plurality of hall call registering means for generating information with respect to hall calls;

a plurality of cage controlling means which are provided in correspondence with a plurality of elevator cages, which generate information with respect to cage calls and cage traffic information in each of the elevator cages and which control the operation of said elevator cages;

learning means which calculates traffic values in unit time zones on the basis of cage traffic information so that when the traffic in a unit time zone is similar to that of an adjacent unit time zone, these time zones are combined into a divided time zone, and when a divided time zone exceeds a predetermined time, a new divided time zone is set; and operation controlling means for controlling said plurality of cage controlling means on the basis of the traffic values for unit time zones, the divided time zones, said information with respect to cage calls and said information with respect to hall calls.

2. An elevator controlling apparatus according to claim 1, wherein said learning means comprises:

statistical processing means for statistically processing traffic in the unit time zones on the basis of the cage traffic information generated by said plurality of cage controlling means;

divided time zone setting means for setting a plurality of divided time zones obtained by dividing the time of a day on the basis of statistical results transmitted from said statistical processing means;

a memory for storing said statistical results obtained in said statistical processing means and said divided time zones; and control information generating means for generating control information on the basis of said statistical results obtained in said statistical processing means and said divided time zones and transmitting said control information to said operation controlling means.

3. An elevator controlling apparatus according to claim 2, wherein said statistical processing means relaxes a traffic change by correcting the traffic value in a referenced time zone by using the traffic values in the unit time zones following and preceding the referenced unit time zone.

4. An elevator controlling apparatus according to claim 2, wherein the divided time zones are at least as large as four unit time zones.

5. A method of controlling elevator cages comprising the steps of:

generating information with respect to cage traffic and hall calls;

calculating traffic values in unit time zones on the basis of cage traffic information;

combining adjacent unit time zones having similar traffic values into a divided time zone, where the divided time zone does not exceed a predetermined time period;

supervising the elevator cages on the basis of the traffic values for unit time zones, the divided time zones, and the information with respect to hall calls.

6. A method of controlling elevator cages according to claim 5 where the traffic values in the unit time zones are calculated using a weighted average of the traffic of each floor of the unit time zone.

* * * * *